US009574152B2

(12) United States Patent
Lai et al.

(10) Patent No.: US 9,574,152 B2
(45) Date of Patent: Feb. 21, 2017

(54) DIESEL FUEL ADDITIVE

(71) Applicant: Hexion Inc., Columbus, OH (US)

(72) Inventors: Zhen Lai, Sugar Land, TX (US); Richard R. Jacobson, Eugene, OR (US); Gilberto Edson Ferreira Saboia, Curitiba-PR (BR); Carlos Nuila, Lake Jackson, TX (US)

(73) Assignee: HEXION INC., Columbus, OH (US)

( * ) Notice: Subject to any disclaimer, the term of this patent is extended or adjusted under 35 U.S.C. 154(b) by 0 days.

(21) Appl. No.: 14/626,782

(22) Filed: Feb. 19, 2015

(65) Prior Publication Data

US 2016/0244687 A1 Aug. 25, 2016

(51) Int. Cl.

| | |
|---|---|
| ***C10L 1/18*** | (2006.01) |
| ***C10L 10/02*** | (2006.01) |
| *C10L 1/19* | (2006.01) |

(52) U.S. Cl.

CPC ..... *C10L 10/02* (2013.01); *C10L 1/18* (2013.01); *C10L 1/19* (2013.01); *C10L 2200/0446* (2013.01); *C10L 2230/081* (2013.01); *C10L 2270/026* (2013.01)

(58) Field of Classification Search

CPC ..... C10L 10/02; C10L 1/18; C10L 1/19; C10L 2200/0446; C10L 2230/081; C10L 2270/026

See application file for complete search history.

(56) References Cited

U.S. PATENT DOCUMENTS

| | | | | |
|---|---|---|---|---|
| 4,032,515 | A | 6/1977 | Blommers et al. | |
| 4,891,049 | A * | 1/1990 | Dillon | C10L 1/19 44/351 |
| 6,387,138 | B1 | 5/2002 | Murayama et al. | |
| 6,890,364 | B2 | 5/2005 | Delfort et al. | |
| 7,097,674 | B2 | 8/2006 | Delfort et al. | |
| 7,637,969 | B2 | 12/2009 | Delgado Puche | |
| 8,142,525 | B2 | 3/2012 | Company et al. | |
| 9,045,707 | B2 * | 6/2015 | Jie | C10L 1/02 |
| 2002/0053161 | A1 | 5/2002 | Lacome et al. | |
| 2004/0025417 | A1 | 2/2004 | Delfort et al. | |
| 2011/0162262 | A1 | 7/2011 | Orlebar et al. | |

OTHER PUBLICATIONS

C.-Y. Hse,Melamine-Bridged Alkyl Resorcinol Modified Urea—Formaldehyde Resin for Bonding Hardwood Plywood, Journal of Applied Polymer Science, vol. 116, 2840-2845 (2010).

* cited by examiner

*Primary Examiner* — Cephia D Toomer

(57) ABSTRACT

A diesel fuel and additive mixture is useful for reducing particulate matter emissions while improving or at least not aggravating oxidative stability during combustion. The additive includes at least one compound having a general formula selected from the group consisting of:

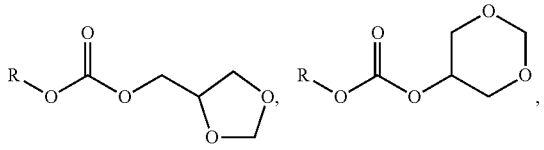

and combinations thereof, wherein: R is a saturated or unsaturated hydrocarbon having from about 1 to about 6 carbons. The additive is effective in diesel at concentrations as low as from about 50 to about 1000 ppm by weight.

11 Claims, No Drawings

DIESEL FUEL ADDITIVE

BACKGROUND OF THE INVENTION

Field of the Invention

The present invention relates to fuel additives. The present invention particularly relates to fuel additives for use in diesel.

Background of the Art

Historically, diesel fuel was one of the least expensive forms of fossil fuels that could be used in automobiles, trucks, and even trains. Due to the advent of environmental regulations which both tightened the specifications on particulates and sulfur, and the imposition of taxes on "gas guzzlers" which served as the impetus to increase miles per gallon of fuel which in turn required that "auto diesel" be useful in such vehicles; diesel is now one of the most expensive fossil fuels.

Due to the environmental movement; it has become desirable to incorporate "renewable" fuels, the so-called "biodiesels," into conventional diesel fuel. Pursuant to that goal, fuels from renewable vegetable sources have seen an impressive increase in use. The biogenic component of these mixed fuels is seen as being more environmentally friendly because it can be more easily broken down (biodegradable). It is also believed that employing biogenic fuels in conventional fuels can mitigate climate change which has resulted in environmental regulations requiring a certain minimum content of bio fuels to be incorporated into conventional fuels.

One area of concern with employing diesel fuel in general and particularly biodiesel and biodiesel/conventional diesel hybrid fuels is a possibility of damage to internal combustion engines due to the presence of corrosive compounds. While biodiesel is more susceptible to oxidation than conventional diesel, oxidation can also arise from employing additives to prevent or mitigate the production of particulate matter during combustion.

Additives that oxygenate the diesel may be employed to reduce particulate matter production during combustion. Conventional oxygenates were reported to be used as main diesel components (minimum at 1.0 weight percent) to reduce particulate matter. Unfortunately, conventional oxygenates that may be blended with a diesel fuel can significantly reduce the fuel's oxidation stability, due to the exacerbated formation of peroxide in the diesel fuel, which can cause a serious problem at ambient storage and handling.

It would be desirable in the art of preparing diesel fuel for use in automobiles and other internal combustion engines to incorporate into the diesel fuel an additive which can eliminate or at least mitigate the production of particulate matter, while at the same time maintaining or improving the oxidation stability of the fuel.

SUMMARY OF THE INVENTION

In one aspect, the invention is a diesel fuel including an additive, the additive including a compound having a general formula selected from the group consisting of:

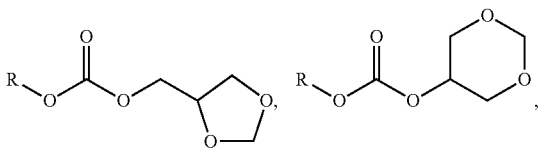

and combinations thereof, wherein: R is a saturated or unsaturated hydrocarbon having from about 1 to about 6 carbons; and the additive is present in the diesel fuel at a concentration of from about 50 to about 1000 ppm by weight.

In another aspect, the invention is an additive for use in diesel fuel including a compound having a general formula selected from the group consisting of:

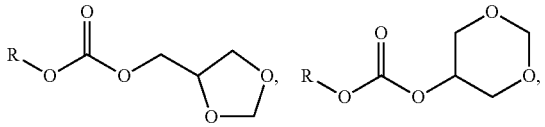

and combinations thereof, wherein: R is a saturated or unsaturated hydrocarbon having from about 1 to about 6 carbons.

In some embodiments, the invention further includes an alkyl or dialkyl carbonate.

DETAILED DESCRIPTION

In one embodiment, the invention is a diesel fuel and an additive, the additive including at least one compound having a general formula selected from

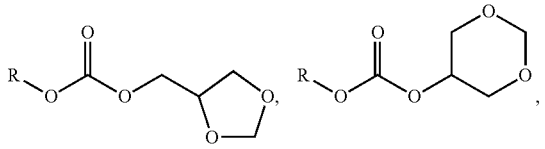

and combinations thereof, wherein: R is a saturated or unsaturated hydrocarbon having from about 1 to about 6 carbons; wherein: R is a saturated or unsaturated hydrocarbon having from 1 to about 6 carbons; and the additive is present in the diesel fuel at a concentration of from about 50 to about 1000 ppm by weight.

For the purposes of this application, the term "diesel fuel" shall mean hydrocarbon fuels derived from petroleum or biogenic sources or combinations thereof and having specifications consistent with the 7 grades set forth in D 975-07. This document is a standard specification for diesel fuel oils which was propagated by the American Society for Testing and Materials and which has been incorporated into the Code of Federal Regulations at 40 CFR 1065.701; wherein it was made binding upon the citizens and residents of the United States of America.

In the practice of one embodiment of the invention of the application, an additive is introduced into a diesel fuel. For the purposes of this application, the term "additive" means a substance added to something in small quantities, typically to improve or preserve it.

In the practice of embodiments of the invention of the application that consist of a mixture of a diesel fuel and an additive, the additive is present at a concentration of from about 50 to about 1000 ppm by weight. In some of these embodiments, the additive is present at a concentration of from about 100 to about 750 ppm by weight. And in other embodiments, it is present at a concentration of from about 300 to 600 ppm by weight.

The additives useful with the embodiments of the application include those having at least one compound selected from compounds corresponding to the following general formulas:

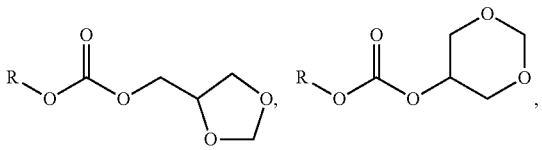

and combinations thereof, wherein: R is a saturated or unsaturated hydrocarbon having from about 1 to about 6 carbons; wherein R is a saturated or unsaturated hard to carbon having from about 1 to about 6 carbons. In some embodiments R will have from about 2 to about 5 carbons; and in still others it will have from about 3 to about 4 carbons. R can be, but is not limited to, a methyl or ethyl group. In a preferred embodiment, compounds corresponding to both formulas are present.

While it is at least theoretically possible that the additive may consist of a compound or compounds corresponding to only one of these general formulas, it is much more likely that it will be a mixture of the formulas. In most manufacturing procedures for these materials, compounds corresponding to both of the general formulas would likely be present and very difficult to separate. For example, in some embodiments the additive can be prepared by the transcarbonation of glycerol formal with an alkyl carbonate. In fact, these components of the additive can be prepared by any method known to be useful to those of ordinary skill in the art of preparing such compounds.

Glycerol formal is also available commercially. For example, glycerol formal sold by Sigma-Aldrich discloses that glycerol formal comprises from about 33 wt. % to about 53 wt. % 4-hydroxymethyl-1,3-dioxolane and from about 47 wt. % to about 67 wt. % of 5-hydroxy-1,3-dioxane. In most embodiments, it would be desirable to consider the concentration of both compounds when determining how much of the additive to employ.

In addition to the components already described, the additives of the application may also include a compound having the general formula:

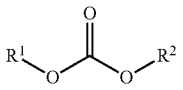

wherein R1 and R2 are the same or different and are hydrogen or a saturated hydrocarbon having from about 1 to about 6 carbons, subject to the caveat that at least one of R1 and R2 is not hydrogen. When present, these compounds may be found in a concentration ranging from about 0.01% to about 80% by weight. In some embodiments they may be present at from 0.1% to about 60% by weight. In other embodiments they may be present at from 1% to about 50% by weight. Exemplary compounds include, but are not limited to: ethyl carbonate, ethyl methyl carbonate, diethyl carbonate, methyl carbonate, and dimethyl carbonate.

When the embodiment of the invention is a diesel fuel including an additive, the additive may be introduced into the diesel fuel in any way known to be useful to those of ordinary skill in the art. For example, in one embodiment the additive and diesel fuel are mixed by introducing the additive into a tank or vessel containing diesel fuel and then agitating the tank or vessel. In another embodiment the diesel fuel and the additive are introduced together into a tank or vessel and the tank or vessel is recirculated. Other methods may also be employed; for example, the additive and the diesel fuel can be mixed using an in-line static mixer.

When introduced into a diesel fuel, the additive of the embodiments of the application functions to prevent or mitigate the formation of corrosive oxidation products. It may also serve to reduce the formation of particulates during the combustion of the fuel and additive mixture.

The additive is introduced into the diesel fuel at a concentration sufficient to be effective as described in the paragraph immediately above but also at a concentration compatible with the diesel fuel. The additives described herein are often very expensive. It would be undesirable to introduce the additive at a concentration higher than that which is compatible with the diesel fuel since the incompatible amounts would not be available to perform their function.

In some embodiments, the invention provides benefits including, but not limited to, reduction of particulate matter emissions from use of high-sulfur diesel fuel, and improvement of the oxidative stability of the fuel without additional antioxidants. A specialty additive which can reduce the particulate matter emissions, without causing any oxidation stability issues is highly desirable in the art of preparing diesel fuel.

EXAMPLES

The following examples are provided to illustrate aspects of the invention. The examples are not intended to limit the scope of the invention and they should not be so interpreted. Amounts are in weight parts or weight percentages unless otherwise indicated.

Additive 1:

Glycerol formal ethyl carbonate, which was prepared by reacting glycerol formal with diethyl carbonate. It has the chemical structure(s) as illustrated below:

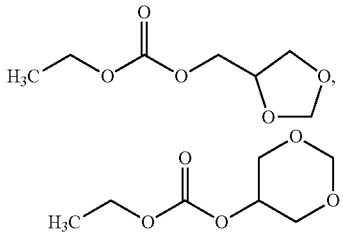

Additive 2:

Contains 55% additive 1 and 45% of diethyl carbonate.

Additive 3:

Glycerol formal methyl carbonate, which was prepared by reacting glycerol formal with dimethyl carbonate. It has the chemical structure(s) as illustrated below:

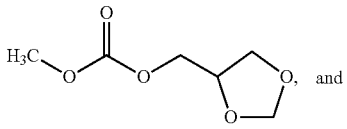

-continued

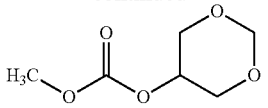

Example 1

Oxidation Stability

A high sulfur diesel (S500) was tested using the standard test methods shown in Table 1 below and was also used as a control. Three samples were prepared. Sample A is the control diesel treated with 500 ppm by weight of additive 1. Sample B is the control diesel treated with 500 ppm additive 2. Sample C is the control diesel treated with 500 ppm additive 3.

The 3 samples were tested substantially identically to the control diesel. The test results are recorded below in Table 1. The results from this test showed that the additives increase the oxidation stability of diesel as compared to the control.

Example 2

Engine Testing

The control and 3 samples (A-C) were subjected to engine testing. The standard engine emissions testing protocol outlined in ECE R49 and US 13-Mode Cycles were followed for the testing, using a Mercedes-Benz OM 366 LA engine. For engine emissions testing, each diesel sample (with additive) was tested three times, and the control sample (control diesel) was tested four times. The average engine emissions results are summarized in Table 2.

The results of the engine testing show that the additives of the application are capable of producing as much as a 32% reduction in particulate matter emissions even when used at the very low concentrations of the test.

Example 3

Compatibility Testing

The control and 3 samples (A-C) were tested to determine the compatibility of the samples in the diesel. Compatibility was determined by adding 10 mL of the control diesel into a glass vial. Variable amounts of the additive, as shown below in Tables 3-6, were introduced into the control. The vial was subjected to shaking (by hand) for 3 minutes to ensure thorough mixing. The vial was then held under ambient conditions for 7 days and then evaluated for any material precipitating, separating or other sign of phase separation as compared to the control. The evaluation was a basic pass/fail where any observed phase separation (such as turbidity or suspended droplets) in the Sample material was a "fail." Samples having an identical appearance as compared to the control were a "pass." The results are shown below in Tables 3-6.

The testing associated with Example 3 demonstrates that the additives are insoluble at 10,000 ppm (1%) or greater concentration in diesel.

Table 1 Summary

Table 1 is referenced in Example 1. The oxidation stability testing shows that the composition with the additive of the invention improves oxidation stability as compared to the control. The remaining data shows that the composition with the additive had equivalent results for other properties. Thus, the composition as described herein using the additive described herein of the invention had improved oxidation stability with equivalent properties in comparison composition without the additive of the invention.

TABLE 1

Summary of Diesel Property Testing Results

| Parameter | Method | Unit | Control | Sample A | Sample B | Sample C |
|---|---|---|---|---|---|---|
| Biodiesel % | DIN EN 14078 | % (weight) | 4.8 | 4.9 | 4.9 | 4.9 |
| Oxidation stability | DIN EN 15751 | hour | 8.9 | 19.3 | 28.4 | 20.9 |
| Recover @ 250 C. | ASTM D86 | %(v/v) | 32.6 | 32.7 | 32.5 | 32.4 |
| | | %(v/v) | 84.7 | 84.7 | 84.7 | 84.7 |
| Recover @ 350 C. | | ° C. | 395.4 | 395.4 | 395.4 | 395.4 |
| 95% recover | | | | | | |
| Density @ 15 C. | DIN EN ISO 12185 | $kg/m^3$ | 856.8 | 856.9 | 856.9 | 856.9 |
| Flash Point | ASTM D93 | ° C. | 51 | 50 | 49 | 49 |
| Kinematic Viscosity | ASTM D445 | $mm^2/s$ | 3.155 | 3.16 | 3.177 | 3.185 |
| Cold Filtered Plug Point | ASTM D6371 | ° C. | −7 | −7 | −8 | −6 |
| Cetane Number | ASTM D6890 | — | 44.7 | 44.8 | 45 | 44.7 |
| Carbon residual | ISO 4262 | % (m/m) | <0.01 | <0.01 | <0.01 | <0.01 |
| Ash | ASTM D482 | % (m/m) | <0.005 | <0.005 | <0.005 | <0.005 |
| Water | DIN EN ISO 12937 | mg/kg | 44 | 54 | 49 | 49 |
| Acid value | ASTM D974 | mg KOH*/g | 0.081 | 0.107 | 0.101 | 0.097 |
| Lubricity | DIN EN ISO 12156-1 | µm | 189 | 200 | 185 | 187 |
| Sulfur | ASTM D5453 | mg/kg | 402 | 402 | 400 | 401 |

*KOH is the acronym for potassium hydroxide

Table 2 Summary

Table 2 is referenced in Example 2. Table 2 displays the results of the engine emissions testing which show that the additives of the application are capable of producing as much as a 32% reduction in particulate matter emissions even when used at the very low concentrations (500 ppm) of the test. This is not shown in the prior art with the claimed additives at the claimed concentrations. The engine emissions testing shows that the additives do not appreciably affect the other emissions tested: oxides of nitrogen, carbon monoxide, and hydrocarbon emissions are essentially unchanged. Power was also unaffected by the additives. These results indicate that the additives are effective at reducing particulate matter emissions without causing poor performance in other emissions and power production, thus the additives are desirable for use in diesel fuel.

TABLE 2

| Summary of Emissions During Engine Tests | | | | | | |
|---|---|---|---|---|---|---|
| | Average (g/kWh) | | | | | PM |
| Tested Diesel | Power (kw) | PM | HC | NOx | CO | Reduction % |
| Control | 56.3 | 0.307 | 0.719 | 5.689 | 1.488 | — |
| Sample A (control diesel + additive 1) | 56.0 | 0.209 | 0.758 | 5.797 | 1.640 | 32.1 |
| Sample B (control diesel + additive 2) | 55.8 | 0.237 | 0.654 | 5.744 | 1.439 | 23.0 |
| Sample C (control diesel + additive 3) | 55.5 | 0.254 | 0.753 | 5.765 | 1.400 | 17.2 |

CO is the acronym for carbon monoxide
$NO_x$ is the acronym for oxides of nitrogen
HC is the acronym for hydrocarbons
PM is the acronym for participate matter Tables 3 Summary Table 3 is referenced in Example 3. This table shows that additives 1-3 which are representative of the additives as claimed, are incompatible in diesel at concentrations of about 10,000 ppm (1 percent) by weight. Additives reported in the prior art which are compatible in diesel at concentrations above 1000 ppm (0.1%) by weight are materially different from the additives claimed in the application. Such additives that are compatible with diesel at concentrations of 10,000 ppm (1 percent) and higher are not within the scope of the additives as claimed in this application.

TABLE 3

| Diesel Compatibility Testing Results for Additives 1-3 | | | | | | | |
|---|---|---|---|---|---|---|---|
| | Control diesel | Control diesel + Additive at 250 ppm | Control diesel + Additive at 500 ppm | Control diesel + Additive at 1,000 ppm | Control diesel + Additive at 5,000 ppm | Control diesel + Additive 8,000 ppm | Control diesel + Additive at 10,000 ppm |
| Additive 1 | | | | | | | |
| Phase Change Observed | n/a | No | No | No | No | No | Yes |
| Fail/Pass | n/a | PASS | PASS | PASS | PASS | PASS | FAIL |
| Additive 2 | | | | | | | |
| Phase Change Observed | n/a | No | No | No | No | No | Yes |
| Fail/Pass | n/a | PASS | PASS | PASS | PASS | PASS | FAIL |
| Additive 3 | | | | | | | |
| Phase Change Observed | n/a | No | No | No | No | Yes | Yes |
| Fail/Pass | n/a | PASS | PASS | PASS | PASS | FAIL | FAIL |

While the foregoing is directed to implementations of the present disclosure, other and further implementations of the disclosure may be devised without departing from the basic scope thereof, and the scope thereof is determined by the claims that follow.

What is claimed is:

1. A diesel fuel comprising diesel fuel including an additive, the additive comprising a compound having a general formula selected from the group consisting of:

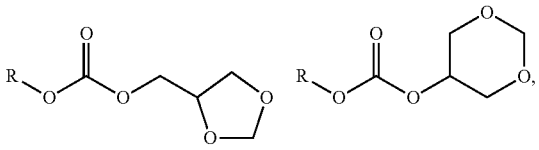

and combinations thereof, wherein:

R is a saturated or unsaturated hydrocarbon having from about 1 to about 6 carbons; and the additive is present in diesel fuel at a concentration of from about 50 to about 1000 ppm by weight.

2. The diesel fuel of claim 1 wherein R has from about 2 to about 5 carbons.

3. The diesel fuel of claim 2 wherein R has from about 3 to about 4 carbons.

4. The diesel fuel of claim 1 wherein the additive additionally comprises a compound having the general formula:

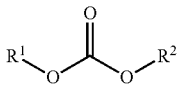

wherein $R^1$ and $R^2$ are the same or different and are a saturated hydrocarbon having from about 1 to about 6 carbons.

5. The diesel fuel of claim 4 wherein $R^1$ and $R^2$ are the same.

6. The diesel fuel of claim 1 wherein R is a methyl group.

7. The diesel fuel of claim 1 wherein R is an ethyl group.

8. The diesel fuel of claim 1 wherein the additive additionally comprises diethyl carbonate.

9. The diesel fuel of claim 1 wherein the additive additionally comprises ethyl methyl carbonate.

10. The diesel fuel of claim 1 wherein the additive is present at a concentration of from about 100 to about 750 ppm by weight.

11. The diesel fuel of claim 10 wherein the additive is present at a concentration of from about 300 to about 600 ppm by weight.

* * * * *